US009981722B2

(12) United States Patent
Carcamo et al.

(10) Patent No.: US 9,981,722 B2
(45) Date of Patent: May 29, 2018

(54) HINGED INFLATABLE SURFBOARD COVER

(76) Inventors: Joseph Carcamo, San Pedro, CA (US); Michael W. Kiger, San Pedro, CA (US)

( * ) Notice: Subject to any disclaimer, the term of this patent is extended or adjusted under 35 U.S.C. 154(b) by 1213 days.

(21) Appl. No.: 12/122,476

(22) Filed: May 16, 2008

(65) Prior Publication Data

US 2009/0283436 A1 Nov. 19, 2009

(51) Int. Cl.
*B63B 35/79* (2006.01)

(52) U.S. Cl.
CPC ..... *B63B 35/7946* (2013.01)

(58) Field of Classification Search
CPC ..... B63B 35/7946; B63B 7/08
USPC ..... 206/522, 315.1
See application file for complete search history.

(56) References Cited

U.S. PATENT DOCUMENTS

| | | | | |
|---|---|---|---|---|
| 3,339,607 | A | 9/1967 | Howard | |
| 3,949,879 | A | 4/1976 | Peterson et al. | |
| 4,719,952 | A | 1/1988 | Geronimo | |
| 4,793,535 | A | 12/1988 | Johnson | |
| 4,801,213 | A * | 1/1989 | Frey et al. | 383/3 |
| 4,951,818 | A * | 8/1990 | Johnson | 206/315.1 |
| 5,033,497 | A | 7/1991 | Hernandez | |
| 5,094,344 | A | 3/1992 | Savage | |
| 5,174,235 | A | 9/1992 | Bamburak et al. | |
| 5,193,677 | A | 3/1993 | Moreno | |
| 5,217,131 | A | 6/1993 | Andrews | |
| 5,218,718 | A * | 6/1993 | Chih | 2/16 |
| D337,432 | S | 7/1993 | Caffiero | |
| 6,003,745 | A | 12/1999 | Mechanic | |
| 6,230,951 | B1 | 5/2001 | Anderson | |
| 6,247,985 | B1 | 6/2001 | Block et al. | |
| 6,334,537 | B1 | 1/2002 | Tepper | |
| 6,394,865 | B1 | 5/2002 | Arzadon | |
| 6,913,803 | B2 * | 7/2005 | Peper | 428/35.2 |
| 7,017,747 | B2 | 3/2006 | Kiger et al. | |
| 2005/0284791 | A1 * | 12/2005 | Sadow | 206/522 |
| 2006/0016842 | A1 * | 1/2006 | Lu | 224/600 |

FOREIGN PATENT DOCUMENTS

| | | |
|---|---|---|
| GB | 2389096 B | 12/2003 |
| JP | 6-144471 | 5/1994 |
| WO | WO 93/09998 | 5/1993 |

OTHER PUBLICATIONS

International Search Report dated Jun. 29, 2009, pp. 1-2.

* cited by examiner

*Primary Examiner* — Anthony Stashick
*Assistant Examiner* — Blaine Neway
(74) *Attorney, Agent, or Firm* — Fulwider Patton LLP

(57) ABSTRACT

Inflatable tubes forming elongated top and bottom sections hingedly connected together along one side and open on the opposite side but closeable about a surfboard for protection thereof.

7 Claims, 5 Drawing Sheets

HINGED INFLATABLE SURFBOARD COVER

BACKGROUND OF THE INVENTION

The present invention relates to devices for protecting surfboards from damage during transit and storage, and more particularly, to surfboard covers for protecting surfaces such as are found on the top, bottom and side rail sections of a surfboard.

DESCRIPTION OF RELATED ART

For many years, surfing has been a well established recreational and sporting activity, and with the progression and increased popularity of the surfing sport, surfers have searched for better designed and constructed surfboards. As the surfing art has progressed, modern technology has produced smaller surfboards that offer greater maneuverability and performance capabilities. Traditional wood or plastic board construction has thus been supplanted by surfboards constructed of lighter and more durable composites, such as, for example, polyurethane or fiberglass.

However, the benefits derived from these lighter and more maneuverable surfboards can be quickly defeated when the surfaces of the board are dented, scratched or otherwise damaged. This is due, at least in part, to the fact that such damage can cause unwanted drag on the board in the water, which will degrade its maneuverability, balance and overall performance. Such damage will typically occur during the transportation of a surfer's board from a home or storage location to a surfing site. During such transport, when the board must be loaded into a vehicle storage compartment and carried therefrom to the water, the surfboard may be subjected to a myriad of impacts or scraped against any number of variously contoured surfaces. Therefore, it is advisable for a surfer to protect his or her surfboard during its transportation to a chosen surfing location. Also, it is especially beneficial to protect specific surfboard surfaces critical to the maneuverability and control of the board such as its side walls (known as "rails" in surfing parlance), its dorsal or top surface on which the surfer stands, and its ventral or bottom surface, which is in contact with the water.

To provide this protection, numerous surfboard covers and carrying cases have been proposed. Some early prior art devices embodied hardened cases for encircling the board similar to guitar cases, but such devices are heavy and awkward during transport, and cannot be collapsed into a smaller and less bulky form for storage when not in use. Other prior art devices have proposed a soft case constructed of fabric or a similar light material, but such a construction, while effective for withstanding minor impacts and scrapes, offers insufficient protection from typical impacts and scraping that must be absorbed during transport or when the surfer accidentally drops the board.

To address this need, various light weight surfboard protectors have been proposed. For example, U.S. Pat. No. 4,719,952 to Geronimo discloses shock absorbing covers, made of a neoprene or synthetic rubber foam sheet material, for individually covering and protecting the forward tip, the rear portion and the side rails of a typical board. However, devices such as this do not provide sufficient protection to the entirety of the top and bottom surfaces of a surfboard, and are unwieldy and awkward to store when not being used to protect it.

Other prior art devices have taught inflatable mats or tubes to protect various surfboard surfaces. For example, U.S. Pat. No. 5,193,677 to Moreno proposes a surfboard bag with a pneumatically inflated guard rail for encircling the circumference of the board's side rails. This guard rail comprises a middle tube and two shorter top and bottom tubes configured to collectively fit the edges of the side rails. However, such a device does not provide for the protection of the remaining surfaces of the board, such as the top and bottom surfaces, and the three tube construction of the guard rail may not be sufficient to prevent impact by an object that may penetrate between the tubes to damage the side rails.

U.S. Pat. No. 6,003,745 to Mechanic discloses a dual purpose surfboard bag that serves both as a sleeping cushion and a board surface protector. Top and bottom pads respectively cover the top and bottom surfaces of the surfboard, and removable and inflatable mats inside the pads protectively sandwich the surfboard while providing a sleeping surface for the surfer. While effective for its intended purpose, the inflatable mats of such a device do not afford adequate protection to all surfaces of the board, especially the side rails, and are not configured to be capable of communication with one another. Further, Mechanic teaches that inflatable mats are to be inserted and fastened into the pads, and that the pads and the mats cooperate to thereafter protect the top and bottom surfaces of the surfboard.

In our previously issued U.S. Pat. No. 7,017,747, we proposed cocoon style inflatable surfboard cover which was closed at the front end and along the opposite sides leaving an opening at the tail end for entry of the surfboard peak first. Devices of this type, while having utility such devices telescopical entry from the rear end of the cocoon style pose certain difficulties in inserting the surfboards. Also, if the interior walls experience any punctures or leaks it is difficult if not impossible to access any such leak for the purpose of patching or the like.

The challenge has been to provide a protective inflatable surfboard cover that is open on its interior for full access thereto but which will also, when closed, provide protection along the rails of the surfboards. It is this solution to which the present invention is directed.

It is this objective which the present invention is directed.

SUMMARY OF THE INVENTION

A pair of elongated top and bottom sections formed by a plurality of coextensive inflatable tubes, the sections being connected together along one side to form a hinge for opening the opposite sides along the longitudinal length of the cover. The tubes cooperate to form a nest in the bottom section for receipt of the bottom surface of a surfboard and inflatable rails are constructed to, when the cover section is closed, embrace the periphery of the board to cushion any impacts that might otherwise be applied to the edges of the board. Fasteners are disposed along the free sides of the sections and at the ends for holding the sections closed on a surfboard housed therein.

Other features and advantages of the invention will become apparent from the following detailed description, taken in conjunction with the accompanying drawings which illustrate, by way of example, the features of the invention.

DETAILED DESCRIPTION OF THE PREFERRED EMBODIMENTS

Figure 1:
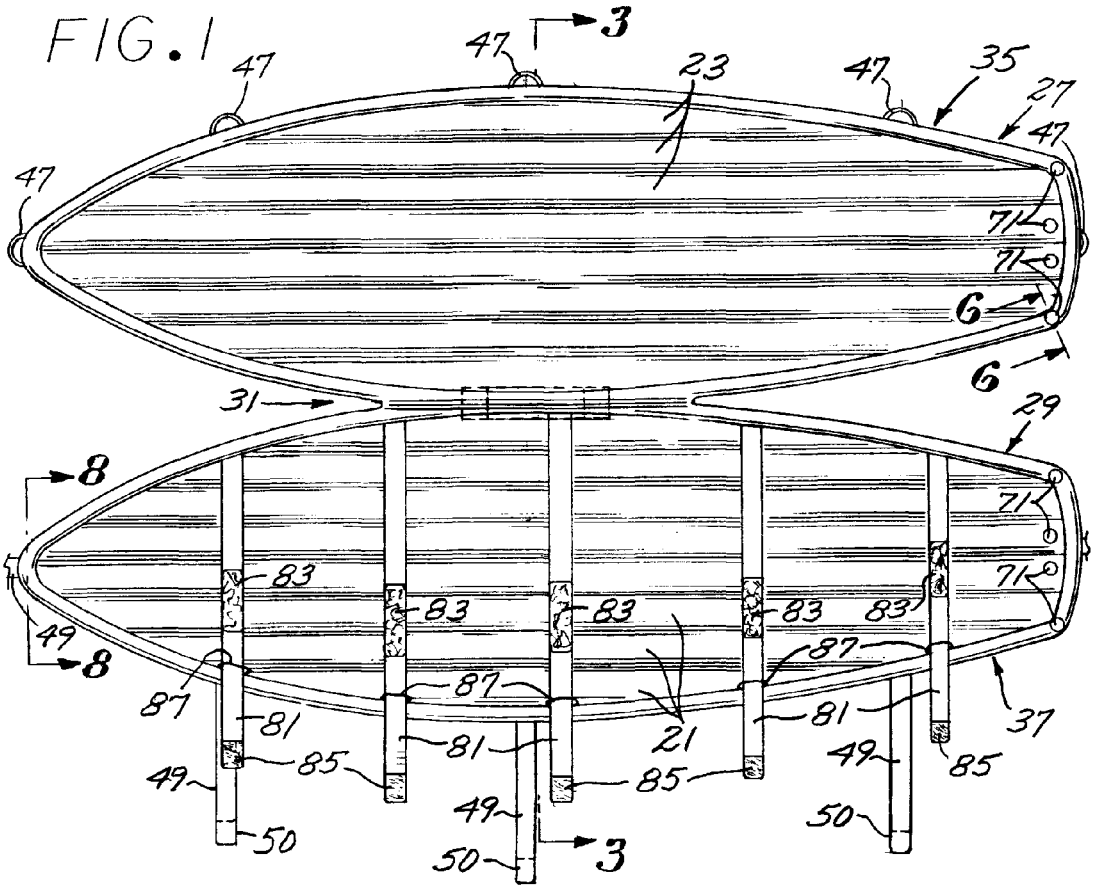
FIG. 1 is a plan view of an inflatable surfboard embodying the present invention, open end clam shell fashion for receipt of a surfboard.
Figure 3:
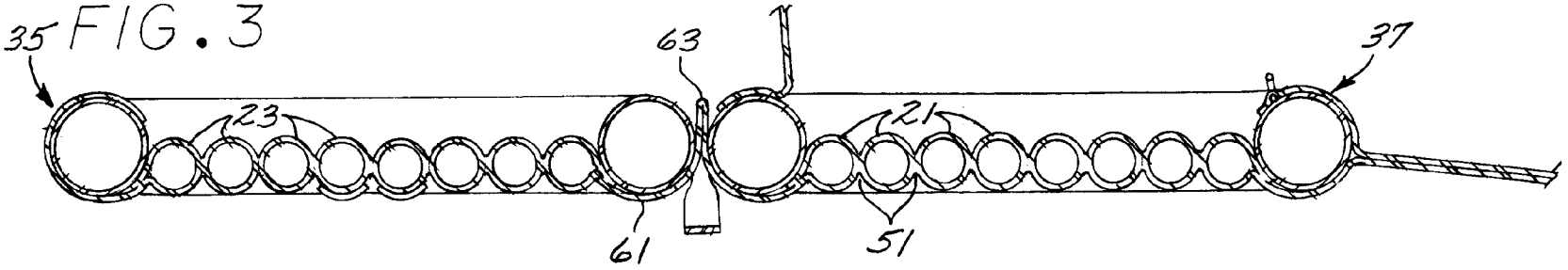
FIG. 3 is a vertical sectional view, in enlarged scale, taken along the line 3-3 of FIG. 1.
Figure 4:
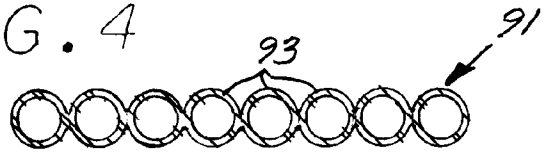
FIG. 4 is a vertical sectional view, in enlarged scale, taken along the line 4-4 of FIG. 2.
Figure 11:
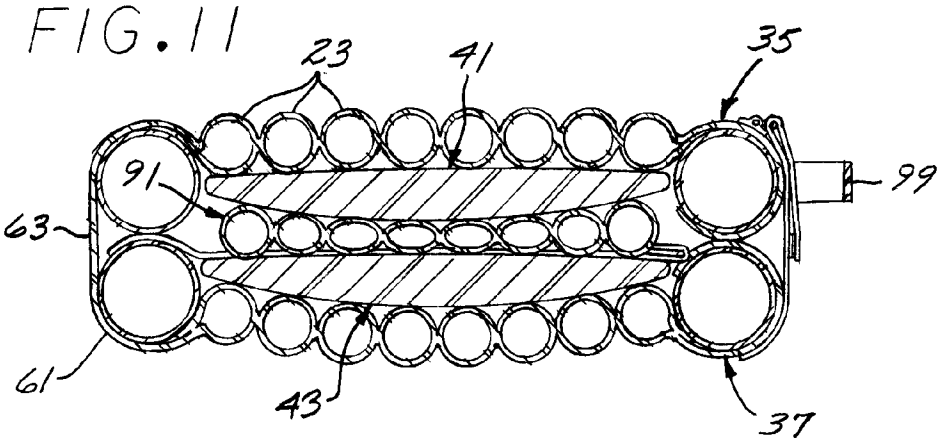
FIG. 11 is a transverse vertical sectional view taken, in enlarged scale, taken along the line of 11-11 of FIG. 10.
Figure 12:
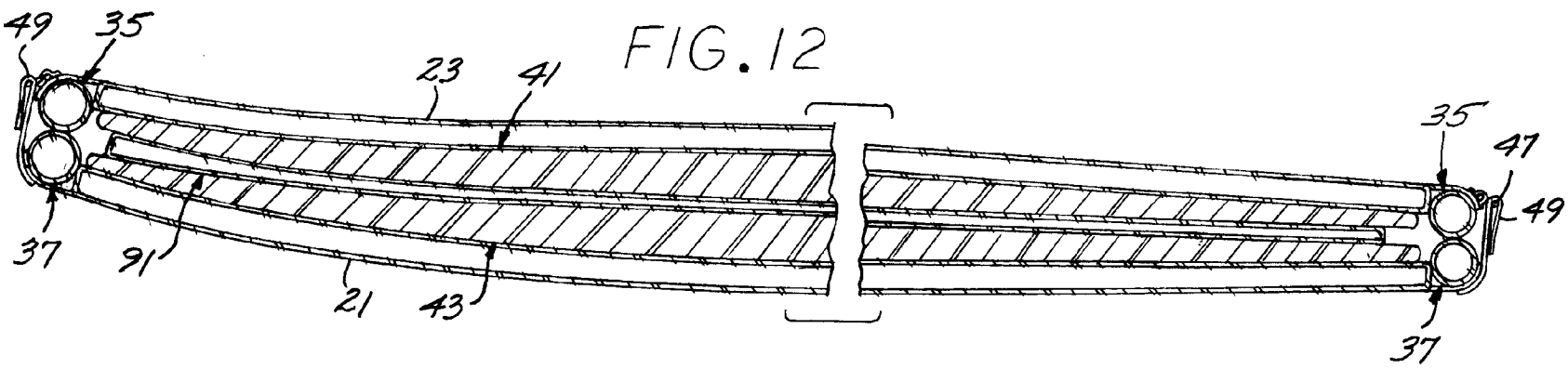
FIG. 12 is a broken longitudinal sectional view, in enlarged scale, taken along the line 12-12 of FIG. 10.

Referring to FIGS. 1 and 3, the inflatable surfboard cover of the present invention includes, generally, a plurality of coextensive inflatable pneumatic tubes 21 and 23 which cooperate to make up respective top and bottom sections, generally designated 27 and 29, connected together at one side by a hinge 31. The sections 27 and 29 are preferably constructed as mirror images to, in plan view, imitate the plan view of a surfboard and one or both include respective enlarged-in-cross section peripheral rail cushions tubes 35 and 37 extending around the respective peripheries of the respective sections to, when the sections are in their closed positions as shown in FIG. 11, cooperate to form a cushioning bumper about the periphery of one or more surfboards 41 and 43 housed therein. The top section 27 is formed along its open side with respective loops defining D-rings 47 for mating with the respective fastener straps 49 connected to the open side of the bottom section 29 and the ends thereof to strap together to form closure fasteners to hold the sections in the closed position shown in FIG. 11

Accomplished surfers take great pride in the selection of high performance surfboards and often travel a great distances and sometimes to somewhat remote areas to have access to ideal surfing waves. Often times surfers travel in groups and each surfer will want to have a surfboard for exercising his or her surfing sport. The surfboard cover of the present invention is constructed to house one or more surfing boards and in the preferred embodiment is constructed to house the surfing boards 41 and 43 as shown in FIG. 11.

Surfboards are typically formed at the fore peak with a narrowed fore section having a somewhat pointed end and the sides thereof curve rearwardly and outwardly to a wide mid ship section and then curve gradually rearwardly and inwardly toward one another to form a somewhat blunt aft end extending transversely (alhwartship). In the preferred embodiment, the surfboard cover of the present invention is constructed to simulate this configuration so that the inflated rail cushion tubes 35 and 37 curved inwardly in toward one another in the respective forward and rearward directions to fairly closely follow the contour of the surfboards to hold them in position and cooperate in providing protection to the edges of the surfboard.

In one preferred embodiment, the surfboard cover incorporates a dual-layered construction laminated to form outer and inner layers. The layers may be formed of any desirable material and are preferably formed from a non-permeable, flexible and durable yet lightweight material that will withstand exposure to the elements such as water and sunlight while also being resistant to tearing and puncturing or other damage that may otherwise occur during transport and storage.

The material may be constructed of a plastic vinyl, nylon, gortex, canvas or other materials well-known in the art which provide flexibility and compactness when deflated. The inner layer of the laminated construction may be of a less durable material but is air impermeable to cooperate in holding pressurized air.

As shown in FIG. 3, the bottom section 37 is constructed of a plurality of pneumatic tubes 21 which may be of identical or varying cross sections but which are typically fused together at their adjoining peripheries 51 and which cooperate to form a layer of pneumatic cushioning material to dispose their upper peripheries in a horizontal plane. The numbers and sizes of such tubes may vary but, in a preferred embodiment the widest portion of the bottom section is formed by eight flanking pneumatic tubes 21 which are the lateral outer two tubes permeating at their rear extremity along a curve defined by the periphery of the opposite sides of the section to provide for flanking tubes at the aft end of the cover.

With continued referenced to FIG. 3, a aft section 35 is of similar construction as formed by the flanking tubes 23 which likewise cooperate to form a layer pneumatic cushion material to protect the dorsal side of a board.

The sections 35 and 37 may include a covering layer 61 which may be formed medially in the area of the hinge 31 with a turn back 63 between the cushioning tubes 35 and 37 on the proximate sides of the respective sections to form the hinge line.

The respective loops 47 may be embedded on one side in the cover layer to receive the fastening straps 49 when the cover sections are closed on each other.

Figure 8:
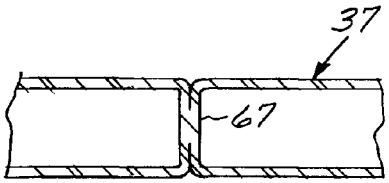
FIG. 8 is a transverse vertical sectional view, in enlarged scale, taken the line 8-8 of FIG. 1.

Referring to FIGS. 1 and 8, the cushioning tubes 35 and 37 are configured at the front extremities with a transverse partition wall 67 to add structural integrity and strength.

Figure 6:
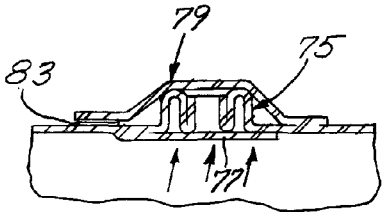
FIG. 6 is a vertical sectional view, in enlarged scale, taken along the line 6-6 of FIG. 1.
Figure 7:
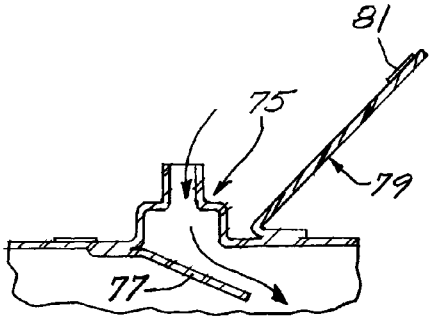
FIG. 7 is a sectional view similar to FIG. 6 but depicting the air valve in an open position.

With a continued reference to FIG. 1, the respective tubes 21 and 23 are formed at their respective one ends with pneumatic valves 71 for inflation thereof. Referring to FIGS. 6 and 7, the valves are of conventional construction including a depressible valve housing neck, generally designated which may be depressed down from the position in FIG. 7 to the recessed position shown in FIG. 6, folded back on itself to form an annular convolution. The valves are configured with flapper tongues 77 which are biased to their closed position shown in FIG. 6 but may be forced opened cantileverally to the open position shown in FIG. 7 as pressurization is commenced. A covering flap 79 is mounted adjacent the respective valves and includes hook and pile fastening material 81 on the free extremity thereof for adjoining with a hook and pile fastener on the body of the respective tubes.

Figure 5:
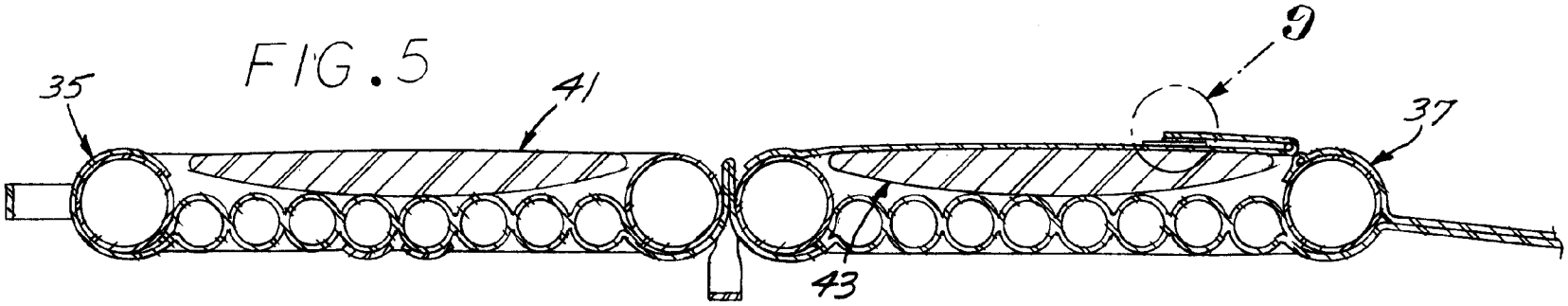
FIG. 5 is a vertical sectional view similar to FIG. 3 but depicting surfboards nested in the and bottom section.
Figure 9:
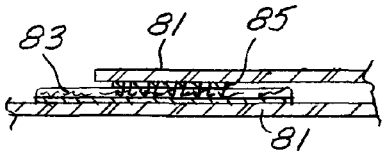
FIG. 9 is a detailed sectional view, in enlarged scale, taken from the circle 9 in FIG. 5.
Figure 10:
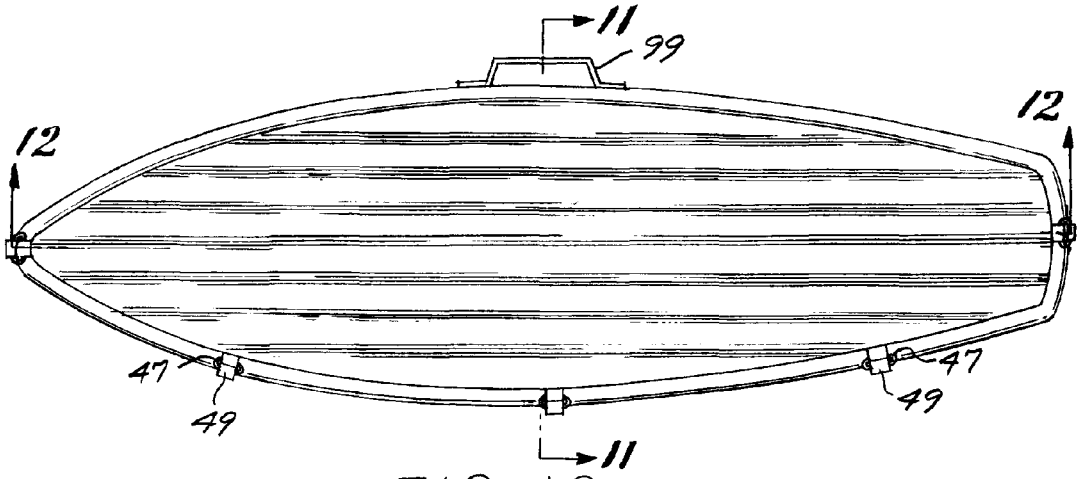
FIG. 10 is a top plan view of the surfboard cover shown in FIG. 1 but depicted in its closed position.

Referring to FIGS. 1, 5 and 9, a plurality of securement straps 81 are connected on their respective one extremities to the lower section cushioning tube 37 in longitudinally spaced apart relationship. The straps 81 include hook and pile fastening strips 83 mounted centrally thereon for mating with corresponding hook and pile fastening strips 85 mounted on the free extremities thereof.

Mounted in corresponding longitudinally spaced relationship along the cushioning tube 37 on the distal side are a plurality of square rings 87 for receipt of the straps 81 so they may be folded back on themselves and secured in fastening relationship as shown in FIGS. 5 and 9.

Figure 2:
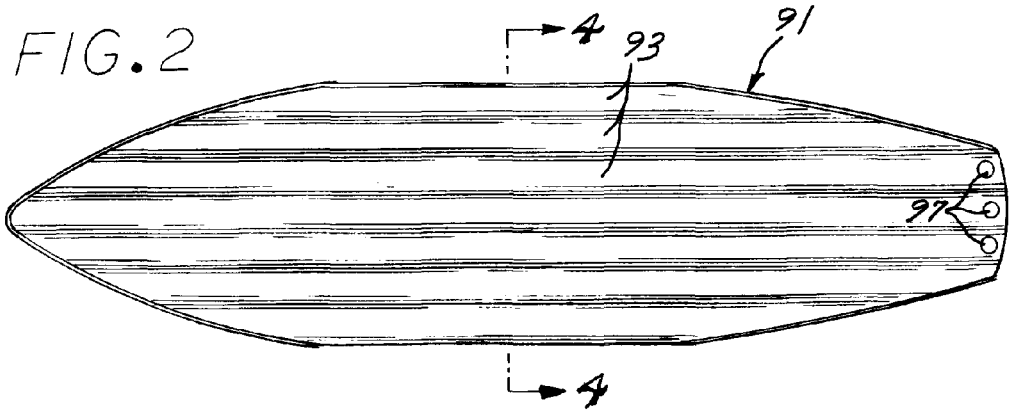
FIG. 2 is top plan view of a divider insert to be inserted between surfboards housed in the top and bottom sections of the cover shown in FIG. 1.

Referring to FIGS. 2 and 11, in one preferred embodiment, the surfboard cover apparatus of the present invention includes a partitioning insert, generally designated 91, constructed of a plurality of side by side inflatable tubes 93 and having an overall plan view configurations somewhat simulating plan view of surfboard. The tubes 93 include respective inflation valves 97 similar to the valves 75.

Thus, the partitioning insert 91 when inflated, may be inserted on top of the bottom surfboard 43 (FIG. 11) to be sandwiched between that board and the top surfboard 41 positioned thereover.

The surfboard cover device may include a handle 99 mounted along one side of the top or bottom sections for toting of the cover.

In operation, when it is desirable to carry a surfboard to a distant location, the user may utilize a foot or electric pneumatic pump to inflate the respective tubes 21, 23, 35, 37 and 93 through the respective inflation valves. It will be appreciated that in various different configuration, two or more tubes may be joined for communication of air there between so that multiple tubes are inflated simultaneously.

Then, with the cover device in the open position as shown in FIG. 1, the surfboard 43 may be nested into the bottom area as shown in FIG. 5 and with the peripheral edges thereof protected from impact by means of the cushion tube 37. The straps 81 may then be laid over the top surface of such surfboard, threaded through the loops 87 and folded back on themselves and attach the loop and pile attachments 83 and 85. In some embodiments, the partitioning insert 91 will be positioned over the top surface of the bottom surfboard 43 and the straps 81 fitted thereover.

In any event, once the straps 81 are secured, in the configuration shown, the insert 91 may be positioned over those straps and the surfboard 91 positioned thereover as shown in FIG. 11. The top section 27 may then be folded over as allowed by the articulating hinge 31 to close the cover section 27 on the bottom section. The closure straps 49 then be threaded the hoops 47 and the straps folded back on themselves and attached per the hook and pile attachments 50 to hold the top and bottom sections in the close protective configuration as shown in FIG. 11 to protect all surfaces of the boards 41 and 43, including side rails and the rear stern rail. It will be appreciated that should the packaged boards be dropped or a piece of luggage or tote cart or the like come into impact with the exterior of the exterior of the inflated cover any such impact will be cushioned by the compressible characteristic of the air in the tubes to thus fully protect the surfboards.

Then, when the destination is reached, the fastener straps 49 may be quickly released and the top and bottom sections opened to the position shown in FIG. 1 to provide for access to the surfboards.

It will also be appreciated that, should the protective cover incur a leak or puncture anywhere on the interior exterior surfaces thereof, ready access could be had to the puncture to effect sealing thereof so as to not unduly interfere with the serviceability and effectiveness of the surfboard cover device.

Figure 13:
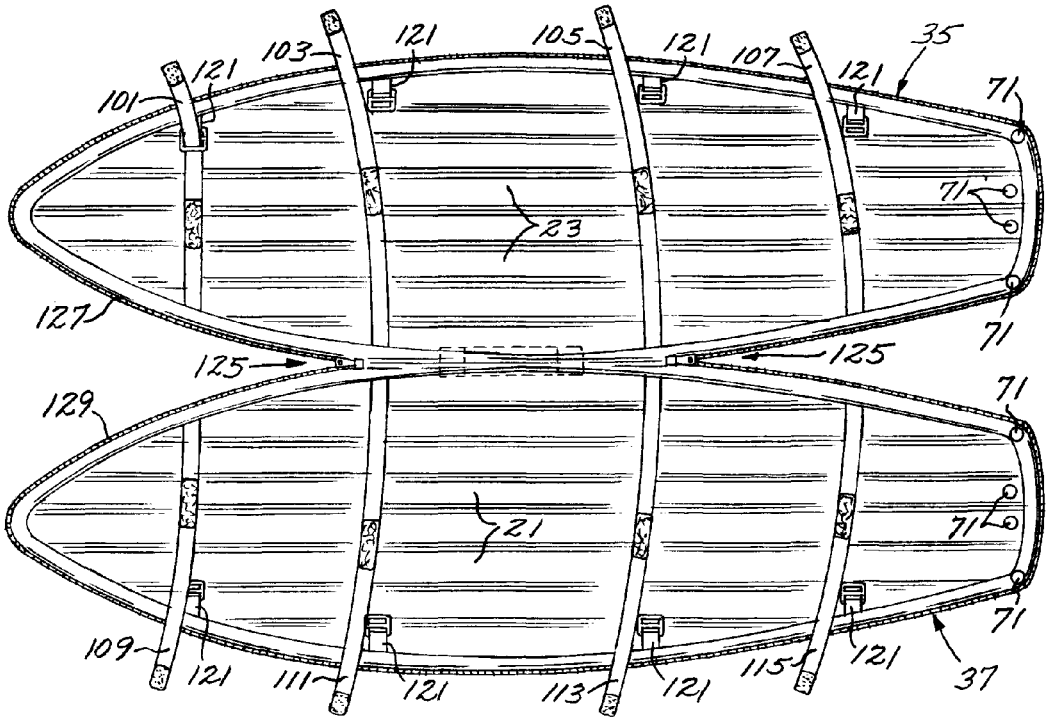
FIG. 13 is a plan view similar to FIG. 1 but of a second embodiment of the surfboard of the present invention.

Referring to the embodiment of our invention shown in FIG. 13, we anchor the respective one ends of fastener straps 101, 103, 105, 107, 109, 111, 113, and 115 to the interior at one side of the bottom section 37 and secure hook and pile strips 121 to the respective free extremities thereof so selected pairs of the straps can be wrapped about the bottom surfboard and the free extremities of the pairs secured together to hold the surfboard in place. As will be apparent to those skilled in the art, the pairs of straps may also be arranged to also fasten around the top surfboard or even both surfboards with the insert 91 sandwiched there between.

In this configuration, we provide a robust plastic zipper, generally designated 125, with the opposite runs 127 and 129 thereof sewn to the peripheral edges of the separable peripheries of the sections 35 and 37 to provide for releasable closure of the cover.

From the foregoing it will be apparent that the pneumatic cover of the present invention provides a lightweight, convenient and effective means for housing a surfboard(s) for transporting thereof.

We claim:

1. A combination inflatable protective surfboard cover device comprising:

an elongated surfboard having top and bottom surfaces and curved lateral opposite rails curving forwardly and inwardly in respective predetermined curves;

elongated top and bottom cover bodies for covering the top and bottom surfaces and configured to complement the shape of the surfboard, the bodies having respective longitudinal centers and first and second lateral sides and being flexibly connected together along the respective first lateral sides and shiftable to a closed position with the top and bottom cover bodies disposed in covering relationship on the respective top and bottom surfaces of the surfboard and openable along the respective second lateral sides to an open position to lay in a horizontal plane with bottom body having an interior bed formed to, when the bottom body is in the horizontal plane, face upwardly, the top and bottom bodies constructed of respective sets of elongated, juxtaposed, inflatable body tubes with adjacent tubes abutted against one another along their lengths and affixed to one another to be, when inflated, self-supporting and, when the cover bodies are in the open position in the horizontal plane cause the top surfaces of the juxtaposed inflatable tubes of bottom body cover to cooperate in forming the horizontal bed;

the body tubes of the respective cover bodies being progressively longer starting from the respective first and second lateral sides and progressing inwardly toward the respective longitudinal centers and formed with respective forward ends cooperating to form respective outlines curving inwardly and forwardly from opposite lateral sides toward one another in the respective predetermined curves;

an inflatable rail tube device extending along the lateral sides of the bottom cover body, mounted to the bottom cover body and constructed to, project forwardly and inwardly along the predetermined curves and constructed to, when the bottom body is laid horizontally and the body tubes and rail tube device inflated, stand vertically above the level of the bed; and a fastener to hold the bodies in the closed position with the rail tube abutted against the respective rails.

2. The combination of the inflatable protective surfboard cover device of claim 1 including:

a plurality of inflatable tubes cooperating to form a partitioning insert configured with a periphery to compliment the shape of the periphery of the bed and configured to be inserted over the top surface of the surfboard for receipt thereon of a second surfboard and wherein:

the cover device is constructed to fit over the first mentioned and second surfboards.

3. The combination of the inflatable protective surfboard cover device of claim 1 wherein:

the top and bottom cover bodies consist only of body tubes.

4. The device of claim 1 wherein:

at least some of the tubes are constructed of a durable material selected from the group of nylon, GORE-TEX® fabric, or canvas.

5. The device of claim 1 wherein:

the tubes are constructed of multiple layers.

6. The device of claim 1 wherein:

the elongated top and bottom cover bodies are configured with the tubes extending lengthwise of the surfboard and the adjacent tubes affixed to one another to cooperate in constructing the top and bottom cover bodies integral.

7. The device of claim 1 wherein:

the tubes are inelastic.

* * * * *